United States Patent [19]

Yoshida et al.

[11] Patent Number: 4,496,453

[45] Date of Patent: Jan. 29, 1985

[54] HYDROGEN-EVOLUTION ELECTRODE

[75] Inventors: Mitsuo Yoshida; Hiroyuki Shiroki, both of Nobeoka, Japan

[73] Assignee: Asahi Kasei Kogyo Kabushiki Kaisha, Osaka, Japan

[21] Appl. No.: 525,603

[22] Filed: Aug. 22, 1983

Related U.S. Application Data

[63] Continuation-in-part of Ser. No. 219,518, Dec. 23, 1980, abandoned.

[30] Foreign Application Priority Data

Dec. 26, 1979 [JP] Japan ..... 54-168180
Nov. 11, 1980 [JP] Japan ..... 55-157582

[51] Int. Cl.[3] ..... C25B 11/04; C25B 11/02
[52] U.S. Cl. ..... 204/290 R; 204/292
[58] Field of Search ..... 204/290 R, 290 F, 291, 204/292, 129

[56] References Cited

U.S. PATENT DOCUMENTS

| | | | |
|---|---|---|---|
| 4,200,515 | 4/1980 | Hall | 204/129 |
| 4,243,497 | 1/1981 | Nicolas | 204/129 |
| 4,249,841 | 9/1977 | Coker | 204/129 |
| 4,384,928 | 5/1983 | Hall | 204/129 |
| 4,412,413 | 12/1983 | Hall | 204/291 |

*Primary Examiner*—John F. Niebling
*Attorney, Agent, or Firm*—Wyatt, Gerber, Shoup, Scobey and Badie

[57] ABSTRACT

A hydrogen-evolution electrode having a coating comprising at least one metal oxide selected from the group consisting of nickel oxide and cobalt oxide and at least one metal selected from the group consisting of nickel and cobalt has been found to exhibit extremely low hydrogen overvoltage and to have not only high catalytic activity but also high durability.

17 Claims, 1 Drawing Figure

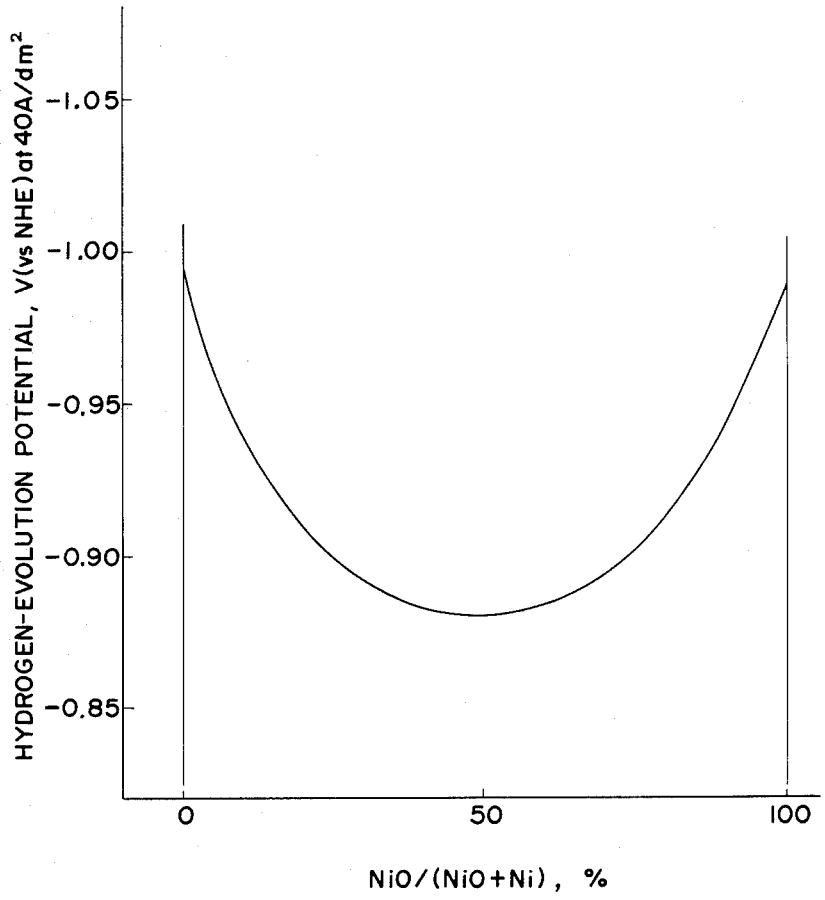
HYDROGEN-EVOLUTION POTENTIAL, V(vs NHE) at 40A/dm²
-1.05
-1.00
-0.95
-0.90
-0.85
0
50
100
NiO/(NiO+Ni), %

HYDROGEN-EVOLUTION ELECTRODE

This application is a continuation-in-part of our U.S. patent application Ser. No. 219,518 filed on Dec. 23, 1980 now abandoned.

This invention relates to a hydrogen-evolution electrode. More particularly, the present invention is concerned with a hydrogen-evolution electrode which not only has a high corrosion resistance and mechanical strength but also exhibits low hydrogen overvoltage and high stability for a long period of time because of being free of occurrence of electrodeposition of iron. Essentially, the present invention is directed to a hydrogen-evolution electrode comprising an electrically conductive substrate having thereon a coating comprising at least one metal oxide selected from the group consisting of nickel oxide and cobalt oxide and at least one metal selected from the group consisting of nickel and cobalt.

Recently, due to the rapid increase in cost of energy, it has become very important more and more to decrease the superfluous consumption of energy by lowering the hydrogen overvoltage of a hydrogen-evolution electrode used in the electrolysis of, for example, water or aqueous alkali metal chloride solution. For this purpose, many researches and developments have been made, but any industrially practicable hydrogen-evolution electrode exhibiting not only a sufficient durability but also a sufficient activity has not been realized yet.

Conventionally known hydrogen-evolution electrodes include those made of iron or mild steel. They are widely used in the form of a plate, wire screen, perforated plate, expanded metal or the like. Iron is most widely used as a material of an electrode because it is easily available at low cost and, in addition, it exhibits a relatively low hydrogen overvoltage when used as an electrode. It has been said that nickel or an alloy thereof is employable as a material of a hydrogen-evolution electrode, but nickel or an alloy thereof is sometimes used only as a material of a bipolar electrode in the electrolysis of water and almost not used as a material of a hydrogen-evolution electrode for other purposes. The reason for this is that nickel or an alloy thereof is expensive and, in addition, there has, heretofore, not occurred a problem of corrosion even with iron which is easily available at low cost.

In recent years, with a view to providing an electrode having lower hydrogen overvoltage, there have been various improved electrodes which each comprise an electrically conductive substrate with its surface having an active material formed thereon. For example, an electrically conductive substrate is coated with corrosive substances such as aluminum, zinc, zirconium dioxide, molybdenum and the like, simultaneously with metals such as nickel, cobalt, a platinum group metal and the like, by melt-spraying, plating or the like, followed by treatment with an alkali or the like so that the corrosive portions are selectively leached to form a porous structure chemically. By the above-mentioned process, there can be obtained an electrode exhibiting sufficiently low hydrogen overvoltage. However, such an electrode exhibiting sufficiently low hydrogen overvoltage is generally so brittle and poor in mechanical strength that it cannot stand a long-time use on an industrial scale. As examples of the electrodes of the above-mentioned kind, there can be mentioned an electrode prepared by a process comprising interdiffusing aluminum and nickel on an electrically conductive substrate to form on the substrate a nickel-aluminum alloy layer from which aluminum is selectively dissolved (see U.S. Pat. Nos. 4,116,804 and 4,169,025); an electrode having a coating of nickel or cobalt formed by melt-spraying and leaching (see U.S. Pat. No. 4,024,044); an electrode comprising an electrically conductive substrate bearing on at least part of its surface a coating of a melt-sprayed admixture consisting essentially of particulate cobalt and particulate zirconia (see U.S. Pat. No. 3,992,278); and an electrode comprising an electrically conductive substrate having a nickel-molybdenum alloy formed thereon (Japanese Patent Application Publication No. 9130/1965).

On the other hand, an electrode comprising an electrically conductive substrate having a coating of only an anti-corrosive substance such as nickel, cobalt, a platinum group metal or the like formed thereon and not accompanied by any chemical treatment such as leaching or the like following the formation of the coating, generally has high mechanical strength but is insufficient in low hydrogen overvoltage characteristics. For this reason, when such an electrode is used in the electrolysis for a long period of time, iron ions which enter into the electrolytic solution little by little from the main raw material, auxiliary materials, materials of the electrolytic cell construction, material of the electrode substrate and the like are caused to be consecutively electrodeposited onto the electrode. As a result of this, the electrode is caused to exhibit the hydrogen overvoltage value of iron in a relatively short period of time, thus losing the effectiveness of the above-mentioned kind of electrode. As examples of the electrode of this kind, there can be mentioned an electrode comprising a ferrous metal substrate having a coating formed by melt-spraying the substrate with a powder of metal nickel or tungsten carbide (see U.S. Pat. No. 4,049,841); and an electrode prepared by subjecting an electrically conductive substrate to nickel-plating, followed by heat treatment (Japanese Patent Applications Laid-Open Specifications Nos. 115675/1978 and 115676/1978).

Moreover, as a further example of the electrode comprising an electrically conductive substrate having a coating of only an anti-corrosive substance, there has been proposed an electrode having a coating of nickel or an alloy of nickel in which a particulate platinum group metal is dispersed (see Japanese Patent Application Laid-Open Specification No. 110983/1979). Such an electrode, however, has a disadvantage that the platinum group metal required is expensive and that, probably due to coming off of the coating layer-carried platinum group metal as the active material, consumption of the electrode tends to occur and hence the long-time use of the electrode causes the activity of the electrode to be lost.

Furthermore, where the electrically conductive substrate of the electrode is made mainly of iron and the coating formed thereon is of a porous structure, during the practical use of such an electrode, the electrolytic solution permeates the porous coating having low hydrogen overvoltage, causing the iron of the substrate to be corroded and dissolved. For this reason, during the long-time use of the electrode, the coating of the electrode is exfoliated and comes off, and due to the dissolution-out of the iron the hydrogen-evolution potential of the electrode cannot be sufficiently noble. The electrodes of the above-mentioned kind include those disclosed in U.S. Pat. Nos. 3,992,278 and 4,024,044. According to the experience of the present inventors, continuously after the initiation of the electrolysis using an electrode of the above-mentioned kind the unfavorable increase in concentration of iron ions in the electrolytic solution is observed. When the electrolysis is continued using the above electrode, the hydrogen overvoltage of the electrode is gradually increased and, at last, the hydrogen-evolution potential of the above electrode is caused not to be different from that of an electrode made of mild steel. Several months after the initiation of the electrolysis the exfoliation and coming-off of the coating of electrode are observed.

Besides, in order to obtain an active coating on the electrode, various methods have been proposed for electroplating or electrolessly plating an active ingredient on an electrically conductive substrate. Among them, there have generally been recommended a method in which a plurality of active ingredients are deposited on an electrically conductive substrate by electroplating or electroless plating and a method in which one active ingredient is deposited on an electrically conductive substrate by electroplating or electroless plating while another ingredient is dispersedly deposited simultaneously with the former ingredient. The above-mentioned two methods, however, are not suitable for producing a hydrogen-evolution electrode on an industrial scale because not only it is difficult to obtain a uniform coating but also the control of the production conditions is complicated.

With a view to developing a practically useful hydrogen-evolution electrode exhibiting low hydrogen overvoltage, the present inventors have made extensive and intensive researches. As a result, they have found that when at least one metal oxide selected from the group consisting of nickel oxide (NiO) and cobalt oxide (CoO) and at least one metal selected from the group consisting of nickel and cobalt are present in the coating of a hydrogen-evolution electrode, the electrode exhibits extremely low hydrogen overvoltage.

Further, the present inventors have made intensive studies on the life of a hydrogen-evolution electrode and, as a result, they have found that the life has a close connection with the material of the electrically conductive substrate of electrode and the electrode potential which the electrode exhibits during the electrolysis. Illustratively stated, it has been found that the electrode life-determining factors largely change according to whether the hydrogen-evolution potential of the electrode is noble or less noble as compared with −0.98 V vs NHE (normal hydrogen electrode).

The present invention has been made based on the above-mentioned novel findings.

Accordingly, it is an object of the present invention to provide a hydrogen-evolution electrode which is excellent in corrosion resistance and mechanical strength and not only exhibits low hydrogen overvoltage for a long period of time but also is stable.

The foregoing and other objects, features and advantages of the present invention will be apparent to those skilled in the art from the following detailed description taken in connection with the accompanying drawing in which:

FIGURE is a graph showing the relationship between the degree of oxidation of the nickel in the coating of electrode and the hydrogen-evolution potential of the electrode;

According to the present invention, there is provided a hydrogen-evolution electrode comprising an electrically conductive substrate having thereon a coating comprising at least one metal oxide selected from the group consisting of nickel oxide (NiO) and cobalt oxide (CoO) and at least one metal selected from the group consisting of nickel and cobalt.

Explanation will now be made on an electrically conductive substrate to be used in the present invention. With respect to the current flowing between a pair of electrodes positioned in opposite relationship in an electrolytic cell, there is a horizontally and vertically non-uniform current distribution. Such a non-uniform current distribution is due to difference in distance from the opposite electrode, shape characteristics of the electrodes, non-uniformity of rate of bubble in the electrolytic solution and non-uniform distribution of resistivity in the partition wall structure. For this reason, also with respect to the electrode which is evolving hydrogen, the overvoltage of the electrode is varied according to portions in the electrode. Illustratively stated, the current is concentrated to the face portion of the hydrogen-evolution electrode confronting the opposite electrode, portions of the electrode in which portions the rate of bubble is relatively small, portions in the vicinity of the electrode and the like. Accordingly, relatively high hydrogen overvoltage is observed in the portions to which the current is concentrated, causing said portions to exhibit relatively less noble potential. On the other hand, only a relatively small current flows in the back side portion of the hydrogen-evolution electrode relative to the opposite electrode, portions in which the rate of bubble is relatively large and the like. Accordingly, relatively small hydrogen overvoltage is observed in the portions in which only a relatively small current flows, causing said portions to exhibit relatively noble potential. Under these circumstances, for convenience's sake, as the value of hydrogen-evolution potential of the electrode, there are used herein such values as measured in the back side portion of the hydrogen-evolution electrode.

Usually, in the electrolysis conducted on an industrial scale, the electrolytic solution often contains heavy metal ions, mainly iron ions, even though the amounts of such ions are very small. For example, such iron ions enter the electrolytic solution as the impurity of the main raw material and/or as the impurity of the auxiliary ions. Further, in some cases, a very small amount of iron which is dissolved from the apparatus and/or equipments enters the electrolytic solution. In general, it is commonly known that the electrolytic solution of the electrolysis using a hydrogen-evolution electrode contains iron ions in an amount of about 0.1 to about 10 ppm. Especially in the case of the electrolysis of an alkali halide, the halide as the raw material which is supplied into the anode chamber contains iron in an amount of several ppm to about 100 ppm. The iron in the anode chamber moves into the cathode chamber through the partition membrane such as an ion exchange membrane, porous membrane or the like. The investigations of the present inventors have revealed that where the hydrogen-evolution potential of the electrode in the electrolysis in which the evolution of hydrogen is involved is less noble as compared with −0.98 V vs NHE, the minute amount of iron is reduction-deposited and accumulated on the surface of the activated electrode consecutively with the lapse of time. When the electrolysis is further continued, the active surface of electrode which has been present is caused to be covered completely by the reduction-deposited iron within 1 to several months, causing the electrode to exhibit the same hydrogen-evolution potential as that of mild steel. Thus, the effect of lowering of hydrogen overvoltage which the activated electrode has exhibited in the beginning is completely lost. Accordingly, the life of the electrode having a hydrogen-evolution potential which is less noble as compared with −0.98 V vs NHE will terminate in a period of time as short as 1 to several months.

On the other hand, in the case of an electrode having a hydrogen-evolution potential which is noble as compared with −0.98 V vs NHE, the life of the electrode is not determined by the consecutive reduction-deposition of the minute amount of iron ions in the electrolytic solution onto the electrode. However, where the electrically conductive substrate of electrode is of iron or mild steel that is most usually employed in the art, the electrolytic solution permeates the low-hydrogen overvoltage porous coating of electrode, causing the iron as the material of the substrate to be corroded and dissolved out. As a result of this, the coating is caused to be exfoliated and come off from the surface of the substrate of electrode. The time in which the coating of electrode is caused to be exfoliated and come off varies depending on the porosity of the coating. In this connection, it is noted that the highly active coating having a hydrogen-evolution potential which is noble as compared with −0.98 V vs NHE often has a considerably high porosity, and hence, the substrate of electrode is continuously contacted with the electrolytic solution through the pores of the coating. For this reason, where there is used a coated electrode exhibiting a hydrogen-evolution potential which is noble as compared with −0.98 V vs NHE and the material of the substrate of electrode is iron, the iron is easily dissolved out electrochemically. For the reasons as mentioned above, it is preferred to employ as material of the substrate of electrode those which are substantially not dissolved electrochemically even at a noble potential as compared with −0.98 V vs NHE. To choose a suitable material to be used as the substrate of electrode in the present invention, the data obtained from the curve of polarization characteristics of a material can be effectively utilized.

The present inventors have made an investigation on electrically conductive materials which are anti-corrosive even at a noble potential as compared with −0.98 V vs NHE. As a result, it has been found that as examples of the material which has an anti-corrosive property sufficient for use as the substrate of electrode and is commercially available easily there can be mentioned nickel, a nickel alloy, an austenite type stainless steel and a ferrite type stainless steel. Of the above-mentioned materials, nickel, a nickel alloy and an austenite type stainless steel are preferred. Nickel and a nickel alloy are most preferred. Besides, those which each are composed of an electrically conductive substrate having on its surface a non-porous coating of nickel, a nickel alloy, an austenite type stainless steel or a ferrite type stainless steel may also preferably be used as the substrate of electrode. Such a non-porous and anti-corrosive coating may be obtained by known techniques, for example, electroplating, electroless plating, melt-plating, rolling, pressure-adhesion by explosion, clothing of metal, vapor deposition, ionization plating and the like.

The preferred shape of the substrate of electrode is of such a structure that hydrogen gas generated during the electrolysis is smoothly released so that a superfluous voltage loss due to the current-shielding by the hydrogen gas may be avoided and that the effective surface area for electrolysis is large so that the current is hardly concentrated. The substrate having such a shape as mentioned above may be made of a perforated metal having a suitable thickness, size of opening and pitch of opening arrangement, an expanded metal having suitable lengths of long axis and short axis, a wire screen having a suitable wire diameter and spacing between the mutually adjacent wires, or the like.

As described before, the hydrogen-evolution electrode according to the present invention is characterized by the provision of a coating comprising at least one metal oxide selected from the group consisting of nickel oxide and cobalt oxide and at least one metal selected from the group consisting of nickel and cobalt. Especially preferred is a coating containing nickel and nickel oxide.

The term "at least one metal oxide" used herein is intended to include a metal oxide and a mixture of metal oxides. They can be identified by the presence of the peaks inherent thereof in the X-ray diffractometry.

The term "degree of oxidation" used herein is intended to indicate the value (%) of $H_1/H_1+H_0$ ($\times 100$) wherein $H_0$ represents the height of a peak showing the intensity of the highest intensity X-ray diffraction line of a metal selected from the group consisting of nickel and cobalt when the coating is analyzed by X-ray diffractomety; and $H_1$ represents the height of a peak showing the intensity of the highest intensity X-ray diffraction line of an oxide of said metal. In case the coating contains nickel, cobalt and oxides thereof, $H_0$ represents the arithmetic mean of the above-mentioned heights of peaks obtained with respect to the metals contained in the coating and $H_1$ represents the arithmetic mean of the above-mentioned heights of peaks obtained with respect to oxides of said metals.

The term "anti-corrosive powder material" used herein is intended to include nickel, cobalt, chromium, manganese, titanium and oxides thereof and the like. Among them, nickel, cobalt, nickel oxide and cobalt oxide are preferable in the present invention. Nickel and nickel oxide are most preferable. Materials which are soluble in an aquoues alkaline solution, such as aluminum, zinc, tin and tungusten, are not included in the anti-corrosive powder material in the present invention.

Referring now to FIGURE, there is given a graph showing the relationship between the degree of oxidation of the nickel in the coating of electrode and the hydrogen-evolution potential of the electrode. In preparing this graph, measurements were done in a 25% aqueous sodium hydroxide solution at 90° C., using the coating having a thickness of 50 to 150 $\mu$. As is apparent from FIGURE, the presence of nickel oxide in the coating of electrode serves to give an electrode having a hydrogen-evolution potential which is noble as compared with −0.98 V vs NHE. With respect to the degree of oxidation, i.e., the value (%) NiO/NiO+Ni($\times 100$), from viewpoints of the desired hydrogen-evolution potential and the life of the electrode, the nickel oxide in the coating may preferably have a degree of oxidation of 20 to 90%.

The reason why such a coating comprising at least one metal oxide selected from the group consisting of nickel oxide and cobalt oxide and at least one metal selected from the group consisting of nickel and cobalt imparts to the hydrogen-evolution electrode a high activity is not yet completely elucidated, but believed to be as follows. In the metal oxide, e.g. nickel oxide in the coating of electrode there are present many metal omission portions, and such omission portions not only exhibit extremely high catalytic activity during the course of adsorption of hydrogen ions, reduction thereof to atoms, bonding of the atoms into hydrogen molecules and desorption of the hydrogen gas but also impart to the nickel oxide an electronic conductivity.

As can be seen from FIGURE, the coating having a degree of oxidation in the range of 20 to 70% exhibits a hydrogen-evolution potential which is extremely advantageous from a practical point of view. The reason for this is believed to be as follows. The presence of such a preferable range of degree of oxidation is due to the fact that while the catalytic activity increases according to the increase of degree of oxidation at a degree of oxidation in the range of 0 to 50% the electronic conductivity decreases according to the increase of degree of oxidation at a degree of oxidation in the range of 50 to 100%.

In the present invention, at least one member selected from chromium, manganese, titanium and oxides thereof may be additionally incorporated into the active coating comprising at least one metal oxide selected from the group consisting of nickel oxide and cobalt oxide and at least one metal selected from the group consisting of nickel and cobalt. Such additional incorporation of at least one member selected from chromium, manganese, titanium and oxides thereof into the active coating is effective for rendering the active coating stable.

Turning back to a general explanation of the electrode of the present invention, the preferred thickness of the coating of electrode is 10 $\mu$ or more. Even when the thickness of the coating is less than 10 $\mu$, there can be obtained an electrode having a hydrogen overvoltage lowered to some extent. However, in order that the electrolysis accompanied by evolution of hydrogen may be conducted not only at a potential at which the minute amount of iron ions is not reduction-deposited on the electrode but also at a practically advantageous current density, it is preferred that the thickness of the coating of electrode be 10 $\mu$ or more. The upper limit of the thickness of the coating is not particularly restricted, but the increase of thickness to more than several hundreds microns only causes the cost for the coating to be increased without any proportional advantage.

With respect to the face of electrode to be coated, there is not a specific restriction. According to need or according to use of the electrode, a coating may be formed on the electrode at its one side or both sides or at its partial portions. In determining the face of electrode to be coated, there may, for example, be adopted a measure in which the desired degree of lowering of hydrogen overvoltage of the electrode is taken into consideration. Needless to say, the larger the rate of coating, the lower the hydrogen overvoltage of the electrode.

With respect to the method of forming on the electrically conductive substrate a coating comprising at least one metal oxide selected from the group consisting of nickel oxide (NiO) and cobalt oxide (CoO) and at least one metal selected from the group consisting of nickel and cobalt, there may be employed known techniques, for example, a method comprising applying an aqueous metal salt solution onto the substrate, followed by sintering; a method comprising pressure-molding, followed by sintering; a method comprising electroplating, followed by oxidizing calcination; a method comprising electroless plating, followed by oxidizing calcination; a dispersion plating method; a melt-spraying method such as flame spraying or plasma spraying; an explosion pressure-adhesion method; and a vapor deposition method. Of these methods, a melt-spraying method is the most suitable method for the purpose. The melt-spraying is conducted using an anti-corrosive powder material comprising at least one member selected from nickel, cobalt, nickel oxide and cobalt oxide, optionally with at least one member selected from chromium, manganese, titanium and oxides thereof.

With respect to the melt-spraying method as an example of the coating method, an explanation will be given hereinbelow.

It is preferred to subject an electrically conductive substrate to a pre-treatment prior to melt-spraying. The pre-treatment consists in degreasing and grinding the surface of substrate. By the pre-treatment, the stains on the surface of substrate are removed and the surface of substrate is appropriately coarsened, thereby enabling great bonding between the substrate and the melt-sprayed coating to be obtained. With respect to the method of pre-treatment, there is not any particular restriction. Usually, there may be employed grinding by an acid-etching, a blast finishing (for example, grit blasting, shot blasting, sand blasting or liquid horning), an electrolytic grinding or the like in combination with degreasing by means of an organic liquid, vapor, calcination or the like.

Methods of coating by melt-spraying include those by flame spraying, plasma spraying and explosion spraying. Of them, flame spraying and plasma spraying are preferably employed in the present invention. The investigations of the present inventors have revealed that in the plasma spraying there is a specific relation between the spraying conditions and the composition and activity of sprayed coating. In general, as the conditions of plasma spraying, there can be mentioned the kind and particle size of the powder material, thickness of the sprayed coating, kind and feeding rate of plasma gas as the plasma source, kind and feeding rate of the powder-feeding gas, voltage and current of the direct arc, distance from the spray nozzle to the substrate to be spray coated, and angle at which the spray nozzle is disposed with respect to the face of substrate to be spray coated. The above-mentioned conditions are said to have, more or less, an influence on the composition and properties of the coating formed by plasma spraying. Particularly, according to the experience of the present inventors, in producing a hydrogen-evolution electrode having high electrochemical activity and low hydrogen overvoltage, consideration should be given to the kind and particle size of the powder material, thickness of the sprayed coating and kind of the plasma gas as the plasma source. Further, the distance from the spray nozzle to the substrate to be spray coated and angle at which the spray nozzle is disposed with respect to the face of substrate to be spray coated have an influence on the yield of spray coating and the degree of oxidation of the coating. Too long a distance from the spray nozzle to the substrate to be coated results in decrease of the yield of sprayed coating, but increases the degree of oxidation of the coating. Too short a distance from the spray nozzle to the substrate to be coated brings about a problem of overheating of the coating. With respect to the angle at which the spray nozzle is disposed with respect to the face of substrate to be spray coated, it is important to choose, according to the state of the face of substrate, an angle which gives the sprayed coating in a highest yield. In the present invention, the distance from the spray nozzle to the substrate to be coated is preferably 50 to 300 mm, and the angle at which the spray nozzle is disposed with respect to the substrate to be coated is preferably 30 to 150°. When the important conditions as specified above are appropriately controlled, even by simply plasma spraying powder metal such as powder nickel onto an electrically conductive substrate, there is obtained an electrode having a sprayed coating in which nickel oxide is present. Such an electrode is able to evolve hydrogen, at a current density as comparatively high as 40 to 50 $A/dm^2$, at a potential which is noble as compared with −0.98V vs NHE.

The analyses of the amounts of nickel oxide in the resulting coating by X-ray diffractometry show that according to the decrease of the particle size of the powder metal nickel to be plasma sprayed, the amount of nickel oxide formed in the sprayed coating tends to increase. The reason for this is believed to be that during the course of melt-spraying the melting of, for example, the powder metal nickel and the partial oxidation of the molten powder metal nickel due to the entanglement thereinto of the oxygen from the atmosphere simultaneously occur under some conditions.

Further, unexpectedly, the coating formed by melt-spraying, for example, nickel oxide alone is also active as a hydrogen-evolution electrode. The analysis of such a coating by X-ray diffractometry shows that in additon to the major part of nickel oxide there is partially formed metal nickel in the coating under some conditions. The reason for this is believed to be that because the central portion of the flame of melt-spray is composed of a strong reducing atmosphere, part of the nickel oxide is reduced simultaneously with melting of the nickel oxide during the course of the melt-spraying.

The nickel oxide formed during the course of the melt-spraying and the nickel oxide which has gone through the melt-spraying respectively have experienced, at high temperatures in an extremely short time, a route of melting of metal→formation of metal oxide→solidification and a route of melting of metal oxide→solidification, so that they are extremely active as a hydrogen-evolution electrode, probably because the compositions of them are non-stoichiometrical.

As is understood from the foregoing description, a powder material useful for forming the active coating is at least one member selected from the group consisting of nickel, cobalt and oxides thereof. The most preferred powder material is at least one member selected from nickel and nickel oxide. The following explanation will be made mainly with respect to nickel and nickel oxide.

As described before, when a coating is formed by melt-spraying, the particle size or diameter of powder material and the distribution thereof have a great influence on the degree of oxidation of the resulting coating, electrochemical activity of the electrode and spraying yield of the powder material. As the powder material, those which have been classified are preferably employed. The average particle size of 0.1 to 200 μ is usable. The average particle size of 1 to 50 μ is more preferred. In case the average particle size is larger than 200 μ, the degree of oxidation of the resulting coating is small and the activity of the coating is insufficient. With the electrode having such a coating, it is impossible to conduct a hydrogen-evolution electrolysis for a long period of time while stably maintaining the hydrogen over-voltage at a low level. On the other hand, in case the average particle size is smaller than 0.1 μ, the spraying yield of the powder material tends to be extremely decreased.

Gases to be used as the plasma source in the plasma spraying include nitrogen, oxygen, hydrogen, argon and helium. The plasma jets obtained from these gases are in the dissociation and ionization states inherent of their respective molecule and atom and, hence, the temperatures, potential heats and velocities of them are extremely different one another. The preferred plasma sources to be used in the present invention are argon, helium, heydrogen, nitrogen and mixtures thereof.

According to the plasma spraying technique in which the powder material is sprayed onto an electrically conductive substrate at a high temperature and at a high velocity, there can be obtained a hydrogen-evolution electrode having a sprayed coating which is imparted with not only high electrochemical activity but also excellent durability, without being accompanied by unfavorable strain and the like due to the heat.

As is apparent from the foregoing description, the content of the active nickel oxide in the coating can be controlled by choosing the particle size of the powder metal nickel as the raw material of plasma spraying, using nickel oxide as the raw material of plasma spraying and/or choosing the appropriate plasma spraying conditions.

The electrode of the present invention can be effectively used as a hydrogen-evolution cathode in the electrolysis of sodium chloride by the ion exchange membrane process or the diaphragm process, electrolysis of alkali metal halides other than sodium chloride, electrolysis of water, electrolysis of Glauber's salt and the like. It is preferred that an electrolytic solution to be in contact with the electrode of the present invention be alkaline. The type of an electrolytic cell to be used together with the electrode of this invention may be of either monopolar arrangement or bipolar arrangement. When the electrode of the present invention is used in the electrolysis of water, it may be used as a bipolar electrode.

The above explanation has been made mainly with respect to nickel and nickel oxide as the main metal and metal oxide. In this connection, it should be noted that, with respect to cobalt and cobalt oxide, the same explanation as mentioned before is applicable.

The present invention will be further illustrated in more detail with reference to the following Examples which should not be construed to be limiting the scope of the present invention.

EXAMPLE 1 AND COMPARATIVE EXAMPLE 1

Two 10 cm×10 cm, 1 mm-thick Nickel 201 (corresponding to ASTM B 162 and UNS 2201) plates were subjected to punching to obtain a pair of perforated plates in which circular openings each having a diameter of 2 mm were arranged at the apexes of equilateral triangles, namely, in 60°-zigzag configuration with a pitch of 3 mm. The perforated plates each were blasted by means of $Al_2O_3$ having a particle size of No. 25 under JIS (Japanese Industrial Standards) (sieve size of 500 to 1,190μ) and degreased with trichloroethylene. The perforated plates each were melt spray coated, on each side thereof, with powder nickel having a purity of at least 99% and a particle diameter of 4 to 7μ by plasma spraying as indicated below. The plasma spraying was repeated 12 times with respect to each side to produce an electrode $A_1$ having a coating of an average thickness of 150μ.

Plasma spraying was done using the following average spraying parameters:

Feeding rate of plasma gas of argon and hydrogen: 4 $m^3$ (at normal state)/hr and 0.5 $m^3$ (at normal state)/hr, respectively Feeding rate of argon as the powder-feeding gas: 1.5 $m^3$ (at normal state)/hr Spray distance: 15 cm Spray angle: 90 degree.

Substantially the same procedures as described above were repeated to obtain electrodes $A_2$, $A_3$ and $A_4$ except that plates made of Incoloy 825 (registered trade mark of alloy manufactured and sold by International Nickel Co., U.S.A.) Inconel 600 (registered trade mark of alloy manufactured and sold by International Nickel Co., U.S.A.) and Monel 400 (registered trade mark of alloy manufactured and sold by International Nickel Co., U.S.A.) were respectively used as materials of substrates instead of Nickel 201. Each one sample of the four kinds of a pair of electrodes thus obtained was analyzed by X-ray diffraction to determine the degree of oxidation of the nickel by calculation from a height of the peak of crystal face (111) with respect to Ni and a height of the peak of crystal face (012) with respect to NiO, respectively. The values of degrees of oxidation [NiO/NiO+Ni (×100)] of the four kinds of electrodes were all 45%.

Substantially the same procedures as described above were repeated except that a perforated plate made of mild steel was used instead of that of Nickel 201, to obtain an electrode $A_5$. The value of degree of oxidation [NiO/NiO+Ni (×100)] was 44%. For the purpose of comparison, an electrode $B_1$ was prepared in the same manner as described just above except that the perforated plate was only blasted and was not coated.

Each other sample of the five kinds of electrodes $A_1$ to $A_5$ and the electrode $B_1$ respectively were installed as a cathode, with a nickel plate as an anode, in the electrolytic cells each containing a 25% aqueous sodium hydroxide solution. Electrolyses were conducted at 90° C. at a current density as indicated in Table 1 to evolve hydrogen. The hydrogen-evolution potential of the cathode was measured in such a manner in which Luggin capillary was connected to the back surface of standard mercury-mercury oxide half cell and in turn was connected to the back surface of said cathode. The results of the measurements are shown in Table 1.

TABLE 1

| Electrode No. | Material used for substrate | Nickel-melt spray-coated layer, μ | Hydrogen-evolution potential, V vs NHE at 20 A/dm² | Hydrogen-evolution potential, V vs NHE at 40 A/dm² |
|---|---|---|---|---|
| $A_1$ | Nickel 201 | 150 (on both sides) | −0.86 | −0.89 |
| $A_2$ | Incoloy 825 | 150 (on both sides) | −0.86 | −0.89 |
| $A_3$ | Inconel 600 | 150 (on both sides) | −0.86 | −0.89 |
| $A_4$ | Monel 400 | 150 (on both sides) | −0.86 | −0.90 |
| $A_5$ | Mild steel | 150 (on both sides) | −0.87 | −0.91 |
| $B_1$ | Mild Steel | None (only blasted) | −1.05 | −1.12 |

Further, there were provided electrolytic cells each of which is partioned by a carboxylic acid type cation exchange membrane commercially available under the registered trademark "Aciplex K-105" (manufactured and sold by Asahi Kasei Kogyo K.K., Japan) into a cathode chamber accommodating therein a cathode and an anode chamber accommodating therein an anode made of a titanium-made expanded metal having thereon a coating composed of ruthenium oxide, zirconium oxide and titanium oxide. As the cathode, the above-mentioned electrodes were used in the electrolytic cells, respectively. While supplying brine having a concentration of 175 g/liter into an anode chamber and supplying a 25% aqueous sodium hydroxide solution into a cathode chamber, electrolyses were continuously conducted at a current density of 40 A/dm² and at 90° C. The anode-cathode voltage and the hydrogen-evolution potential of the cathode were measured and the results are shown in Table 2.

TABLE 2

| Electrode No. | Anode-cathode voltage, V at 40 A/dm² At initial stage | After 950 hrs | After 3,200 hrs | Hydrogen-evolution potential, V (vs NHE) at 40 A/dm² At initial stage | After 950 hrs | After 3,200 hrs |
|---|---|---|---|---|---|---|
| $A_1$ | 3.20 | 3.20 | 3.21 | −0.89 | −0.89 | −0.90 |
| $A_2$ | 3.21 | 3.20 | 3.20 | −0.89 | −0.89 | −0.89 |
| $A_3$ | 3.21 | 3.21 | 3.21 | −0.90 | −0.89 | −0.90 |
| $A_4$ | 3.20 | 3.21 | 3.20 | −0.90 | −0.90 | −0.89 |
| $A_5$ | 3.23 | 3.29 | 3.44 | −0.91 | −0.94 | −1.10 |
| $B_1$ | 3.45 | 3.46 | 3.45 | −1.12 | −1.11 | −1.13 |

With respect to the electrode $A_5$, both the anode-cathode voltage and the hydrogen-evolution potential changed at the same rate, and 3,200 hours after the initiation of the electrolyses, there were no differences in anode-cathode voltage and hydrogen-evolution potential between the electrode $A_5$ and the electrode $B_1$. After 3,200 hours' electrolyses, the electrolytic cells were dismantled to examine the electrodes $A_5$ and $B_1$. The almost overall surfaces of the electrodes $A_5$ and $B_1$ were observed to be covered with a black substance and the analyses by X-ray diffraction showed that the black substance was a reduced iron. The reduced iron adhered to the surfaces of the electrode $A_5$ was removed to examine the plasma sprayed layer and it was observed that exfoliation and coming-off of the coating partially occurred and part of the plasma sprayed layer rose off the substrate.

In contrast, with respect to the electrodes $A_1$, $A_2$, $A_3$ and $A_4$, any specific change was not observed in appearance when the electrodes were examined upon dismantling the electrolytic cell and in performance even after the electrolyses were conducted for a period of 3,200 hours. Specifically stated, both of the anode-cathode voltage and the hydrogen-evolution potential of the electrodes according to the present invention remained unchanged as they were at the initial stage, and any deposition of the iron on the surface of the electrode and exfoliation of the plasma sprayed layer were not observed.

EXAMPLE 2

Six 5 cm×5 cm, 1 mm-thick Inconel 600—made plates were subjected to punching to obtain six perforated plates in which circular openings each having a diameter of 2.5 mm were arranged at the apexes of equilateral triangles, namely, in 60°-zigzag configuration with a pitch of 3.5 mm. The same pre-treatments of the perforated plates as in Example 1 were conducted in substantially the same manner as described in Example 1 and then the perforated plates were melt spray coated, on each side thereof, with powder nickel and/or nickel oxide by plasma spraying in substantially the same manner as described in Example 1 to obtain electrodes $A_6$, $A_7$, $A_8$, $A_9$, $A_{10}$ and $A_{11}$ each having, on each side thereof, a 180 μ-thick coating. With respect to the electrodes $A_6$, $A_7$, $A_8$ and $A_9$, the raw material of plasma spraying was powder nickel whose particle diameter, however, was varied according to the electrode as indicated in Table 3. The electrode $A_{10}$ and the electrode $A_{11}$ were obtained by the plasma spray coating of a 50:50 powder nickel-nickel oxide mixture and a powder nickel oxide, respectively. 15 The six kinds of electrodes thus prepared were respectively installed as a cathode, with a nickel plate as an anode, in the electrolytic cells each containing a 25% aqueous sodium hydroxide solution. Electrolyses were conducted at 90° C. at a current density as indicated in Table 3 to evolve hydrogen. The hydrogen-evolution potential of the cathode was measured in the same manner as described in Example 1. The results of the measurements are shown in Table 3. The electrodes were also analyzed by X-ray diffraction with respect to the degree of oxidation [NiO/NiO+Ni(×100)] from heights of the peaks of the X-ray diffraction chart. The results of the analyses are shown in Table 3.

TABLE 3

| Electrode No. | Powder material | Range of particle diameter, μ | Degree of oxidation in the coatings, % | Hydrogen-evolution potential, V vs NHE at 20 A/dm² | Hydrogen-evolution potential, V vs NHE at 40 A/dm² |
|---|---|---|---|---|---|
| $A_6$ | nickel | 10–20 | 20 | −0.88 | −0.91 |
| $A_7$ | " | 5–15 | 32 | −0.88 | −0.90 |
| $A_8$ | " | 4–7 | 44 | −0.87 | −0.89 |
| $A_9$ | " | 2–5 | 58 | −0.87 | −0.89 |
| $A_{10}$ | nickel + nickel oxide (50:50) | 4–7<br>3–8 | 66 | −0.87 | −0.90 |
| $A_{11}$ | nickel oxide | 3–8 | 88 | −0.90 | −0.94 |

EXAMPLE 3

Eight 5 cm ×5 cm, 1.2 mm-thick Incoloy 825 - made plates were subjected to punching to obtain eight perforated plates in which circular openings each having a diameter of 1.5 mm were arranged at the apexes of equilateral triangles, namely, in 60° -zigzag configuration with a pitch of 3 mm. The same pre-treatments of the perforated plate as in Example 1 were conducted in substantially the same manner as described in Example 1 and then the perforated plates were melt spray coated, on each side thereof, with powder nickel by plasma spraying in substantially the same manner as described in Example 1 (except that a mixed gas of nitrogen and hydrogen was used as the plasma gas) to obtain electrodes $A_{12}$, $A_{13}$, $A_{14}$, $A_{15}$, $A_{16}$, $A_{17}$, $A_{18}$ and $A_{19}$ with a coating of varied thickness as indicated in Table 4. The electrodes $A_{12}$ to $A_{16}$ had their respective coatings of thicknesses ranging from 25 to 400μ formed thereon, and the coatings of each of the electrodes had the same thickness on both sides of the electrode. The electrode $A_{17}$ had a 150 μ-thick coating formed on its front side and a 50 μ-thick coating formed on its back side. The electrode $A_{18}$ had a 200 μ-thick coating formed on its front side and a 25 μ-thick coating formed on its back side. The electrode $A_{19}$ had a 10 μ-thick coating formed on both sides. In any case, plasma spraying was done by using powder nickel having a particle diameter of 4 to 7μ.

The eight kinds of electrodes thus prepared were respectively installed as a cathode, with a nickel plate as an anode, in the electrolytic cells each containing a 25% aqueous sodium hydroxide solution. Electrolyses were conducted at 90° C. at a current density as indicated in Table 4 to evolve hydrogen. The hydrogen-evolution potential of the cathode was measured in the same manner as described in Example 1. The results of the measurements are shown in Table 4.

TABLE 4

| Electrode No. | Thickness of coating, μ Front side | Thickness of coating, μ Back side | Degree of oxidation, % | Hydrogen-evolution potential, V vs NHE at 20 A/dm² | Hydrogen-evolution potential, V vs NHE at 40 A/dm² |
|---|---|---|---|---|---|
| $A_{12}$ | 25 | 25 | 42 | −0.93 | −0.96 |
| $A_{13}$ | 50 | 50 | 42 | −0.89 | −0.92 |
| $A_{14}$ | 100 | 100 | 44 | −0.87 | −0.90 |
| $A_{15}$ | 200 | 200 | 45 | −0.87 | −0.89 |
| $A_{16}$ | 400 | 400 | 48 | −0.87 | −0.89 |
| $A_{17}$ | 150 | 50 | 45 | −0.87 | −0.89 |
| $A_{18}$ | 200 | 25 | 45 | −0.88 | −0.90 |
| $A_{19}$ | 10 | 10 | 40 | −0.98 | −1.03 |

There were provided electrolytic cells each including a cathode and an anode made of a titanium-made expanded metal having thereon a coating composed of ruthenium oxide, zirconium oxide and titanium oxide and a carboxylic acid type cation exchange membrane commercially available under the registered trademark "Aciplex K-105" (manufactured and sold by Asahi Kasei Kogyo K.K., Japan) whereby there are formed an anode chamber and a cathode chamber partitioned by said membrane. As the cathode, the above-mentioned electrodes were used in the electrolytic cells, respectively. While supplying brine having a concentration of 175 g/liter into an anode chamber and supplying a 25% aqueous sodium hydroxide solution into a cathode chamber, electrolyses were continuously conducted at a current density of 40 A/dm² and at 90° C. 2,400 Hours after the initiation of the continuous electrolyses, no change was observed with respect to the anode-cathode voltage and hydrogen-evolution potential of all the electrodes $A_{12}$ to $A_{18}$. Illustratively stated, the anode-cathode voltages at which the electrolyses were conducted in the seven electrolytic cells respectively containing the electrodes $A_{12}$ to $A_{18}$ changed within the range of 3.18 to 3.26 V, and the hydrogen-evolution potentials of the electrodes changed within the range of −0.89 to −0.97 V vs NHE. After 2,400 hours' electrolyses, the electrolyses were dismantled to examine the hydrogen-evolution electrodes $A_{12}$ to $A_{18}$. Not only any deposition of iron on the surfaces of the electrodes but also any exfoliation of the plasma sprayed coating were not observed.

In contrast, the electrolysis could be conducted in the electrolytic cell containing the electrode $A_{19}$ with good performance at the initial stage, but both the anode-cathode voltage and the hydrogen-evolution potential of the electrode changed with the lapse of time so that after about 2,000 hours, there was not observed any difference in anode-cathode voltage and hydrogen-evolution potential between the electrode $A_{19}$ and the iron-made electrode. Illustratively stated, the anode-cathode voltage with respect to the electrode $A_{19}$ changed from 3.32 V at the initial stage to 3.48 V after 2,000 hours, and the hydrogen-evolution potential of the electrode changed from −1.03 V vs NHE to −1.11 V vs NHE. During the time of 2,000 to 2,400 hours after the initiation of the electrolysis, the above-mentioned voltage and potential remained unchanged, namely, at 3.4 V and −1.11 V vs NHE, respectively. After 2,400 hours' electrolysis, the electrolytic cell was dismantled to examine the hydrogen-evolution electrode $A_{19}$. It was confirmed that the overall surface of the electrode was covered with the deposited iron and about 20% of the circular openings of the perforated plate were blocked.

EXAMPLE 4

Five 5 cm×6 cm, 1 mm-thick plates made of a stainless steel (SUS 316L under JIS) and one 5 cm×6 cm, 1 mm-thick plates made of E-brite 261 (trade name of a product manufactured and sold by Airco Co., U.S.A.) were subjected to punching to obtain six perforated plates in which circular openings each having a diameter of 2 mm were arranged at the apexes of equilateral triangles, namely, in 60°-zigzag configuration with a pitch of 3 mm. The same pre-treatments of the perforated plate as in Example 1 were conducted in substantially the same manner as described in Example 1 and then the perforated plates were melt spray coated, on each side thereof, with various materials as indicated below and in Table 5 by plasma spraying in substantially the same manner as described in Example 1 to obtain electrodes $A_{20}$ to $A_{25}$ each, on both sides thereof, having a 170 μ-thick coating. It is noted that the SUS 316L - made plate was employed as the material of the substrates for the production of the electrodes $A_{20}$ to $A_{24}$, while the E-brite 261- made plate was employed as the material of the substrate for the production of the electrode $A_{25}$. The electrode $A_{20}$ was obtained by the plasma spraying of powder cobalt. The electrodes $A_{21}$ to $A_{25}$ were obtained by the plasma spraying of a 50:50 mixture of two members selected from powder metal nickel, cobalt, nickel oxide and cobalt oxide.

Each of the six kinds of electrodes $A_{20}$ to $A_{25}$ was installed as a cathode, with a nickel plate as an anode, in the electrolytic cells each containing a 25% aqueous sodium hydroxide solution. Electrolyses were conducted at 90° C. at a current density as indicated in Table 5 to evolve hydrogen. The hydrogen-evolution potential of the cathode was measured in the same manner as in Example 1. The results are shown in Table 5.

TABLE 5

| Electrode No. | Powder material used for melt spray coating | Range of particle diameter, μ | Degree of oxidation, % | Hydrogen-evolution potential, V vs NHE at 20 A/dm² | Hydrogen-evolution potential, V vs NHE at 40 A/dm² |
|---|---|---|---|---|---|
| $A_{20}$ | Cobalt | 5–10 | 40 | −0.87 | −0.90 |
| $A_{21}$ | Cobalt, Cobalt oxide (50/50) | 5–10, 3–8 | 65 | −0.87 | −0.90 |
| $A_{22}$ | Nickel, Cobalt (50/50) | 4–7, 5–10 | 45 | −0.88 | −0.90 |
| $A_{23}$ | Nickel, Cobalt oxide (50/50) | 4–7, 3–8 | 65 | −0.87 | −0.90 |
| $A_{24}$ | Cobalt, Nickel oxide (50/50) | 5–10, 3–8 | 60 | −0.86 | −0.89 |
| $A_{25}$ | Nickel oxide, Cobalt oxide (50/50) | 10–50, 3–8 | 90 | −0.90 | −0.95 |

What is claimed is:

1. In a hydrogen-evolution electrode comprising an electrically conductive substrate and a coating formed on the surface of said substrate, the improvement in which:

said electrically conductive substrate is nickel or a nickel alloy;

said coating on the surface of said substrate comprises at least one metal oxide selected from the group consisting of nickel oxide (NiO) and cobalt oxide (CoO) and at least one metal selected from the group consisting of nickel and cobalt and has a degree of oxidation of 20 to 90%, said degree of oxidation of the coating being defined by the formula $$\frac{H_1}{H_1 + H_0} \times 100$$

wherein $H_0$ represents the height of a peak showing the intensity of the highest intensity X-ray diffraction line of a metal selected from the group consisting of nickel and cobalt when the coating is analyzed by X-ray diffractometry; $H_1$ represents the height of a peak showing the intensity of the highest intensity X-ray diffraction line of an oxide of said metal; and in case the coating contains nickel, cobalt and oxides thereof, $H_0$ represents the arithmetic mean of the above-mentioned heights of peaks obtained with respect to the metals contained in the coating and $H_1$ represents the arithmetic means of the above-mentioned heights of peaks obtained with respect to oxides of said metals; and said coating is a coating fabricated by the melt-spraying of an anti-corrosive powder material comprising at least one member selected from the group consisting of nickel, cobalt, nickel oxide and cobalt oxide.

2. An electrode according to claim 1, wherein said melt-spraying is plasma spraying.

3. An electrode according to claim 1, wherein said powder material has an average particle size of 0.1 to 200 μ.

4. An electrode according to claim 1, wherein said powder material consists of at least one member selected from the group consisting of nickel and nickel oxide.

5. An electrode according to claim 4, wherein said coating is composed of nickel and nickel oxide.

6. An electrode according to any of claims 1 or 2, wherein said coating has a thickness of 10μ or more.

7. An electrode according to claim 1, wherein the electrode has a hydrogen-evolution potential which is noble as compared with −0.98 vs normal hydrogen electrode.

8. An electrode according to claim 1, wherein said powder material comprises at least one member selected from the group consisting of nickel oxide and cobalt oxide.

9. In a hydrogen-evolution electrode comprising an electrically conductive substrate and a coating formed on the surface of said substrate, the improvement in which:

said substrate comprises an electrically conductive substrate body and a non-porous layer of nickel or nickel alloy on said substrate body, said non-porous layer being formed by electroplating, electroless plating, melt-plating, rolling, pressure-adhesion by explosion, clothing of metal, vapor deposition or ionization plating to form a surface layer of the substrate;

said coating is formed on said non-porous layer of the substrate and comprises at least one metal oxide selected from the group consisting of nickel oxide (NiO) and cobalt oxide (CoO) and at least one metal selected from the group consisting of nickel and cobalt and has a degree of oxidation of 20 to 90%, said degree of oxidation of the coating being defined by the formula $$\frac{H_1}{H_1 + H_0} \times 100$$

wherein $H_0$ represents the height of a peak showing the intensity oi the highest intensity X-ray diffraction line of a metal selected from the group consisting of nickel and cobalt when the coating is analyzed by X-ray diffractometry; $H_1$ represents the height of a peak showing the intensity of the highest intensity X-ray diffraction line of an oxide of said metal; and in case the coating contains nickel, cobalt and oxides thereof, $H_0$ represents the arithmetic mean of the above-mentioned heights of peaks obtained with respect to the metals contained in the coating and $H_1$ represents the arithmetic mean of the above-mentioned heights of peaks obtained with respect to oxides of said metals; and said coating is a coating fabricated by the melt-spraying of an anti-corrosive powder material comprising at least one member selected from the group consisting of nickel, cobalt, nickel oxide and cobalt oxide.

10. An electrode according to claim 9, wherein said melt-spraying is plasma spraying.

11. An electrode according to claim 9, wherein said powder material has an average particle size of 0.1 to 200μ.

12. An electrode according to claim 9, wherein said powder material consists of at least one member selected from the group consisting of nickel and nickel oxide.

13. An electrode according to claim 12, wherein said coating is composed of nickel and nickel oxide.

14. An electrode according to claim 9, wherein said coatig has a thickness of 10μ or more.

15. An electrode according to claim 9, wherein the electrode has a hydrogen-evolution potential which is noble as compared with −0.98 vs normal hydrogen electrode.

16. An electrode according to claim 1, wherein said powder material comprises at least one member selected irom the group consisting of nickel oxide and cobalt oxide.

17. An electrode according to claim 9, wherein said powder material comprises at least one member selected from the group consisting of nickel oxide and cobalt oxide.

* * * * *

UNITED STATES PATENT AND TRADEMARK OFFICE

CERTIFICATE OF CORRECTION

PATENT NO. : 4,496,453

DATED : January 29, 1985

INVENTOR(S) : Mitsuo Yoshida; Hiroyuki Shiroki

It is certified that error appears in the above—identified patent and that said Letters Patent is hereby corrected as shown below:

Cancel Claim 16.

Signed and Sealed this

*Twenty-seventh* Day of *May 1986*

[SEAL]

*Attest:*

DONALD J. QUIGG

*Attesting Officer*

*Commissioner of Patents and Trademarks*